US010480132B1

(12) United States Patent
Jennings

(10) Patent No.: US 10,480,132 B1
(45) Date of Patent: Nov. 19, 2019

(54) FIXED SCREED POWER TAKE-OFF FOR IMPROVED PERFORMANCE

(71) Applicant: Caterpillar Paving Products Inc., Brooklyn Park, MN (US)

(72) Inventor: Todd Jennings, Ramsey, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/052,330

(22) Filed: Aug. 1, 2018

(51) Int. Cl.
*E01C 19/40* (2006.01)
*E01C 19/48* (2006.01)

(52) U.S. Cl.
CPC ..... *E01C 19/40* (2013.01); *E01C 19/4853* (2013.01); *E01C 2301/14* (2013.01)

(58) Field of Classification Search
CPC ..... E01C 19/40; E01C 2301/14
USPC ..... 404/118
See application file for complete search history.

(56) References Cited

U.S. PATENT DOCUMENTS

| | | | | |
|---|---|---|---|---|
| 4,213,749 | A | 7/1980 | Morrison | |
| 4,335,976 | A | 6/1982 | Morrison | |
| 4,340,351 | A | 7/1982 | Owens | |
| 4,685,826 | A | 8/1987 | Allen | |
| 6,116,006 | A * | 9/2000 | Killen | A01D 57/20 56/11.9 |
| 8,128,314 | B2 | 3/2012 | Buschmann et al. | |
| 8,896,150 | B1 | 11/2014 | Shammoh | |
| 8,979,425 | B2 | 3/2015 | Graham et al. | |
| 9,045,871 | B2 | 6/2015 | Graham et al. | |
| 10,208,435 | B2 * | 2/2019 | Stallgies | E01C 19/40 |
| 2015/0337505 | A1 * | 11/2015 | Stallgies | E01C 19/40 404/118 |

* cited by examiner

*Primary Examiner* — Gary S Hartmann
(74) *Attorney, Agent, or Firm* — Harrity & Harrity LLP

(57) ABSTRACT

An extendable section, for attachment to a fixed screed, may include a rotatable shaft, and a power receiving component attached to the rotatable shaft. The power receiving component may receive power generated during rotation of a drive shaft, and generate torque and speed for rotating the rotatable shaft. Increasing the driving rotational speed of the drive shaft may increase a driven rotational speed of the rotatable shaft, and decreasing the driving rotational speed of the drive shaft may decrease the driven rotational speed of the rotatable shaft.

20 Claims, 5 Drawing Sheets

FIXED SCREED POWER TAKE-OFF FOR IMPROVED PERFORMANCE

TECHNICAL FIELD

The present disclosure relates generally to a fixed screed included in a screed assembly and, more particularly, to a fixed screed, included in a screed assembly, having power take-off for powering components disposed in an extendable section included in the screed assembly, in order to provide improved performance of the components.

BACKGROUND

Paving machines may be used in the laying of bituminous roadway mat. A typical paving machine employs a screed assembly (sometimes referred to as a floating screed) for spreading and compressing a bituminous material to form a smooth surfaced roadway mat. The screed assembly may include, as an accessory, an extendable section for attachment to an end of a fixed section of the screed assembly, in a rear or forward mounted arrangement. The extendable section may include an adjustable end gate that allows an operator to adjust an effective width of the screed assembly, for forming roadway mats that comply with wider tolerances. The extendable section may also facilitate overwidth paving of the roadway mats to accommodate various roadway features (e.g., driveway entrances, tie-ins, and/or the like).

The extendable and fixed sections of the screed assembly may include vibrating and/or tamper components for imparting vibrating and/or tamper functionality, which improve the screed assembly's compactive abilities. In this regard, and, in an effort to improve the uniformity of roadway mat surfaces, it may be desirable for the vibrating and/or tamper functionality imparted by the fixed sections to closely match the vibrating and/or tamper functionality imparted by the extendable sections. Generally, this has proven difficult to achieve, as the addition of complex control components, to the screed assembly, are required to provide similar and/or consistent vibrating and/or tamper functionality across the extendable and fixed sections.

Further difficulties may arise in connection with transmitting power to the extendable sections. For example, long sections of hosing are currently being used to transmit power from a base of the fixed screed, located at a center of the screed assembly, to the extendable sections, located at or near the ends of the screed assembly. The long sections of hosing may be cumbersome, difficult to store, and/or difficult to assemble.

One attempt to address one such issue, and to provide improved control over operation of an extendable section, is disclosed in U.S. Pat. No. 8,979,425, that issued to Caterpillar Paving Products Inc., on Mar. 17, 2015 ("the '425 patent"). Per the '425 patent, an electro-hydraulic system is provided to extend or retract the extendable screed relative to the main screed, and includes an on/off switch to move and stop the extendable screed as a desired width of paving. However, greater control is required to move and vary the width of paving using the extendable screed. The '425 patent discloses providing a screed assembly that includes a control system for the extendable screed. The control system includes a first input device configured to set a speed limit for the extendable screed, a second input device configured to vary a speed of the extendable section, within the speed limit, and a third input device configured to govern a relationship between a speed of the extendable screed and a relative position of the second input device.

While the control system disclosed by the '425 patent addresses a method of improving control over a speed and/or movement of an extendable screed, a need exists for improved screed assemblies in order to address problems relating to routing power to the extendable screed and/or problems relating to inconsistent tamper and/or vibrating functionality provided by the main screed and the screed extension, and/or other problems in the art.

SUMMARY

According to some implementations, the present disclosure is related to a paving machine comprising a screed assembly. The screed assembly includes a fixed section and an extendable section disposed proximate an end of the fixed section. The fixed section may include a drive shaft, and the extendable section may include a driven shaft. A power transmitting component may be coupled to the drive shaft. The power transmitting component may be configured to generate power in response to rotation of the drive shaft, for actuating the driven shaft.

According to some implementations, the present disclosure is related to a screed assembly, including a fixed section comprising a drive shaft, and an extendable section, extending from a portion of the fixed section. The extendable section may include a driven shaft. The screed assembly may further comprise a power transmitting component coupled to the drive shaft. The power transmitting component may be configured to generate power during rotation of the drive shaft, and the power may be configured to actuate the driven shaft.

According to some implementations, the present disclosure is related to an extendable section of a screed assembly including a rotatable shaft and a power receiving component attached to the rotatable shaft. The power receiving component may be configured to receive power generated during rotation of a drive shaft, and generate torque and speed for rotating the rotatable shaft. Increasing a driving rotational speed of the drive shaft may increase a driven rotational speed of the rotatable shaft, and, decreasing the driving rotational speed of the drive shaft may decrease the driven rotational speed of the rotatable shaft.

DETAILED DESCRIPTION

Figure 1:
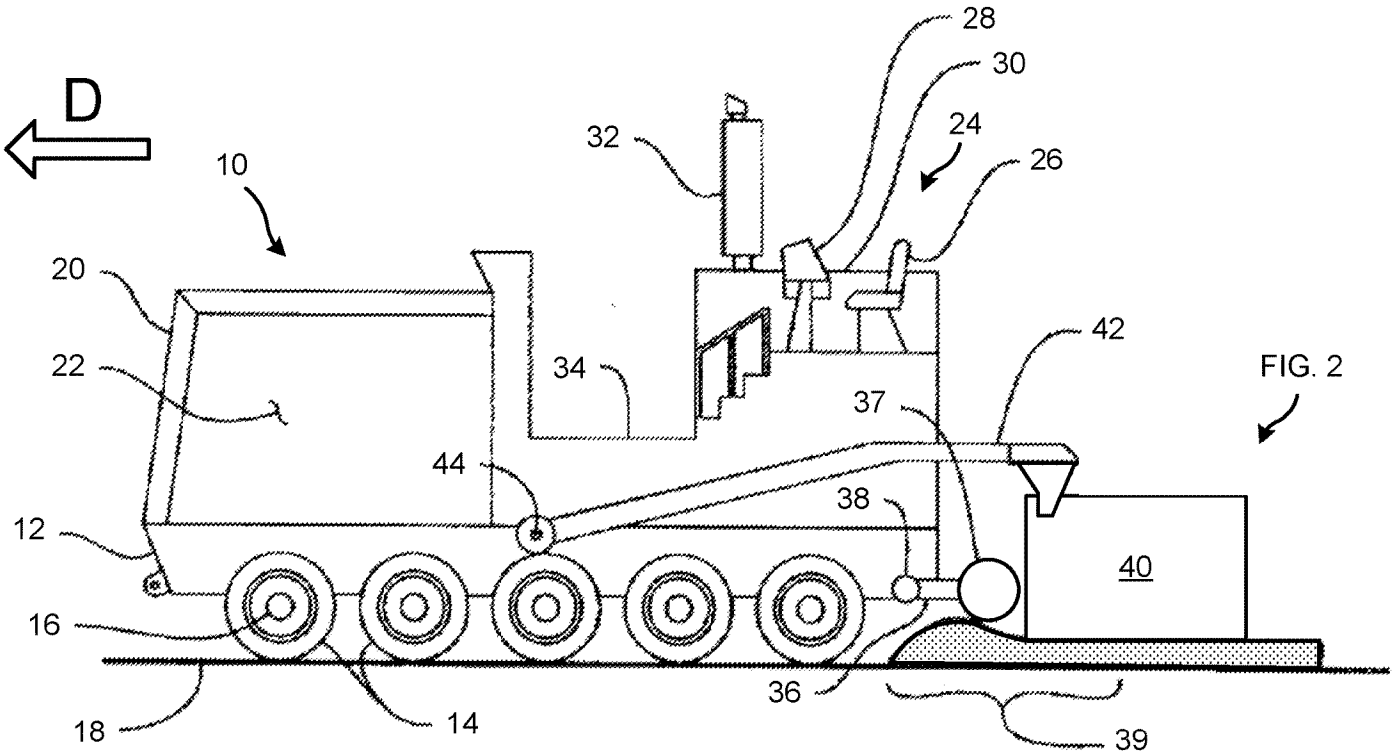
FIG. 1 is a diagram of an example paving machine that includes a screed assembly.

FIG. 1 is a diagram of an example paving machine 10 that includes a screed assembly 40. As shown, paving machine 10 may include a frame 12 that is supported by and transported upon a plurality of transport wheels 14 oppositely disposed on axles 16 that extend underneath frame 12 transverse to a direction D of travel or motion of paving machine 10. A hopper 20 may be disposed on a forward portion of frame 12. Hopper 20 may include sides 22 extending vertically from frame 12 so that hopper 20 can receive material (e.g., bituminous aggregate material, such as asphalt) from a transport vehicle (e.g., a dump truck), and retain the material in hopper 20 pending disposition of the material on a surface 18 to be paved by paving machine 10.

As shown, towards a rear of the frame 12, an operator station 24 may be provided so that an operator, seated in a chair 26, can control operation of paving machine 10 by way of controls provided on a control panel 28. Also disposed toward the rear of the frame 12 may be an engine housing 30, on which is provided an exhaust stack 32 for exhausting combustion by-products of engine housing 30. As further shown in FIG. 1, a walkway area 34 may be provided to permit access by personnel (e.g., the operator, members of a paving crew, and/or the like) to paving machine 10.

As further shown in FIG. 1, a screed assembly 40 may be connected to frame 12 by a set of screed support arms 42. In some cases, the set of screed support arms 42 may be substantially parallel and horizontal to one another, extending along frame 12, and be pivotally connected to frame 12 by an arm pivot 44, which may include a horizontal axis transverse to the direction D of travel of paving machine 10, thus permitting vertical movement of screed assembly 40. While not shown, paving machine 10 may include an apparatus by which vertical movement of screed assembly 40 may be limited and/or controlled. As described below in association with FIG. 2, screed assembly 40 may include a fixed screed (e.g., 46, FIG. 2), to which one or more extendable sections (e.g., 48, FIG. 2) may be mounted, attached, or otherwise disposed.

As further shown, paving machine 10 may further include an aggregate disposition apparatus 36. Aggregate disposition apparatus 36 may include an auger 37 (e.g., a flighted auger) disposed adjacent a rear of frame 12 in an approximate horizontal and axially transverse position relative to the direction D of travel of paving machine 10. As further shown, an auger support member 38 may be arranged for controlling a position of aggregate disposition apparatus 36. As an example, auger 37 may include a flighted auger that provides at least two oppositely directed flights of material 39 from a centerline of paving machine 10, for directing a substantially equal amount of material 39 towards outer edges of screed assembly 40.

As indicated above, FIG. 1 is provided as an example. Other examples are possible and may differ from what was described in connection with FIG. 1. In other words, paving machine 10, the components shown as being included in paving machine 10, and the arrangement of these components, are provided for illustrative purposes only. Additionally, FIG. 1 does not illustrate scale representations of paving machine 10 and/or the components shown as being included in paving machine 10. Rather, paving machine 10, as described herein is not intended to be limiting, but is intended to be illustrative of apparatuses and applications in which implementations, described herein, may be employed.

Figure 2:
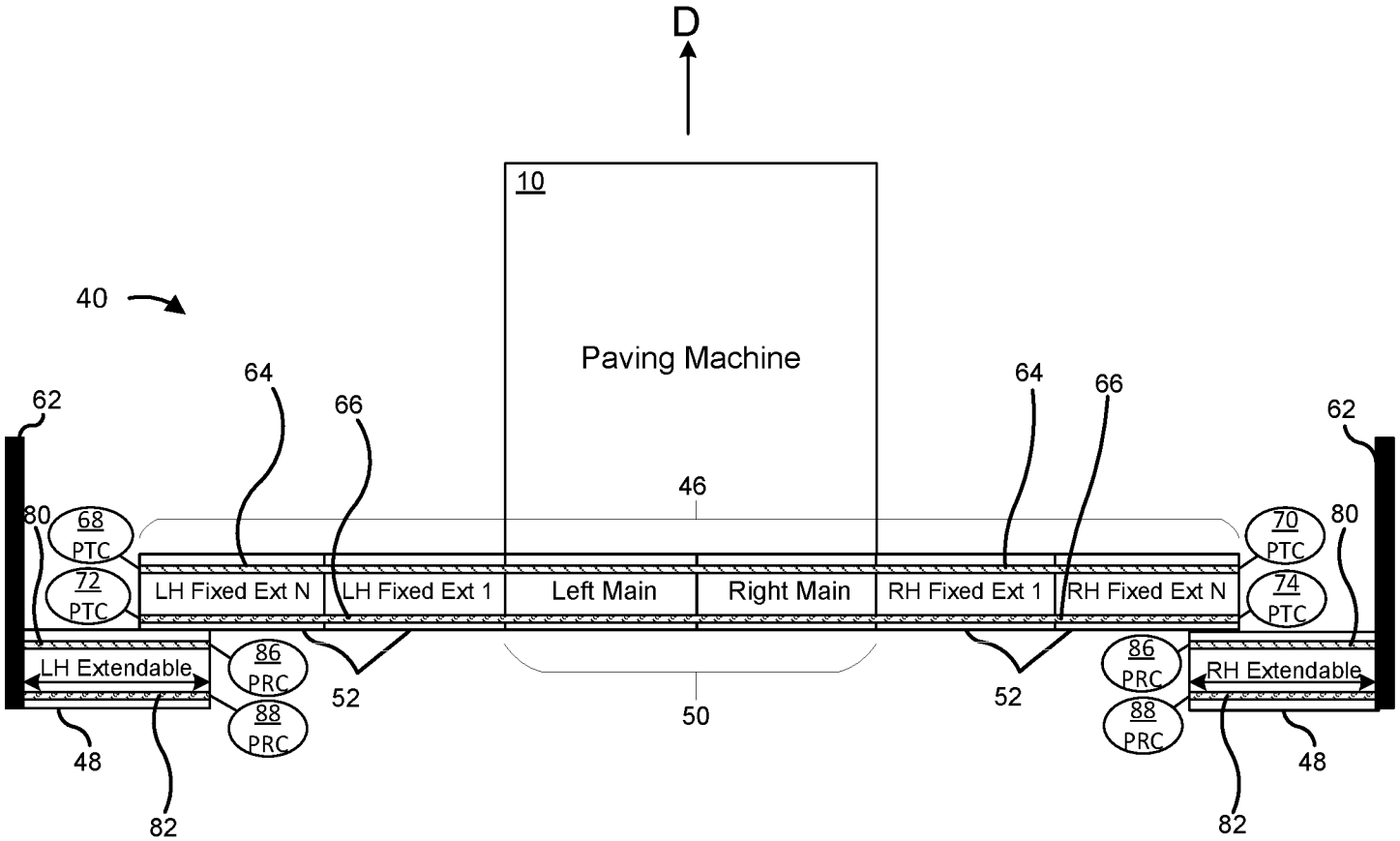
FIG. 2 is a schematic diagram of an example screed assembly, including a fixed screed having power take-off for powering components of extendable sections of the screed assembly, that may be used in the paving machine of FIG. 1.

FIG. 2 is a schematic diagram of an example screed assembly 40, including a fixed screed 46 having power take-off for powering extendable sections 48 of the screed assembly 40, that may be used in the paving machine 10 of FIG. 1. For purposes of clarity, some components shown and described in association with FIG. 1 are omitted from FIG. 2.

As shown in FIG. 2, screed assembly 40 is comprised of a centrally disposed fixed screed 46, and one or more extendable sections 48, located at or near the ends of fixed screed 46. Such extendable sections 48 may be mounted or attached to fixed screed 46 in any manner consistent with the present disclosure. For example, in some implementations, extendable sections 48 may be bolted, clamped, or otherwise secured to fixed screed 46 by way of one or more mechanical connectors (e.g., one or more bolts, clamps, pins, etc.). The extendable sections 48 may be independently movable relative to the fixed screed 46, such that each extendable section 48 may be independently extended to a different length, and, for example, receive power from portions of fixed screed 46 by way of power take-off provided by one or more shafts of the fixed screed, as described herein.

In some implementations, fixed screed 46 is comprised of a base screed 50 (e.g., also referred to as a main screed) and one or more fixed sections 52, that are optionally attached to base screed 50, or one or more (e.g., intermediate) fixed sections 52, where multiple fixed sections 52 are provided. In some implementations, fixed sections 52 include fixed extensions used, for example, to increase a width of fixed screed 46 for accommodating various paving applications, the size and/or number of which may vary based on a width of a roadway mat to be formed by screed assembly 40. A fixed section 52 may be mounted or attached to base screed 50 and/or one or more additional fixed sections 52 in any manner consistent with the present disclosure, for example, by way of one or more bolts, clamps, pins, and/or the like.

In some implementations, extendable sections 48 (e.g., variable extensions) may be disposed at or near the ends of screed assembly 40, whereby extendable sections 48, or portions thereof, may extend or retract, as needed, to facilitate increases or decreases in an overall width of screed assembly 40. In some implementations, extendable sections 48 include end gates 62, which are configured to extend or retract relative to fixed screed 46, by which overall width may be increased, or decreased, as desired (e.g., for overwidth paving, wider tolerances, etc.).

Extendable sections 48 may be removably attached to one or more ends of fixed screed 46, including opposite faces or ends of fixed screed 46. Although extendable sections 48 are shown as being attached to ends of fixed sections 52, attachment of extendable sections 48 to ends of base screed 50 is also contemplated. Extendable sections 48, in addition to fixed sections 52, may include covers, by which various components may be covered, housed, or partially enclosed.

Still referring to FIG. 2, in some implementations, fixed screed 46 comprises one or more rotatable shafts (e.g., drive shafts) and/or shaft assemblies, which provide power take-off to one or more components of extendable sections 48. Such rotatable shafts and/or shaft assemblies may be disposed in and/or extend through fixed screed 46, or portions thereof, including, for example, portions of base screed 50, one or more fixed sections 52, and/or combinations thereof. In some implementations, the one or more rotatable shafts and/or shaft assemblies extend along an axis that is orthogonally disposed, or substantially orthogonally disposed, relative to the direction D of travel of paving machine 10.

In some implementations, fixed screed 46 includes at least a first drive shaft 64 and/or at least a second drive shaft 66 extending through one or more fixed sections 52 thereof. First drive shaft 64 and second drive shaft 66 may, additionally, or alternatively, extend through portions of base screed 50. First drive shaft 64 and second drive shaft 66 may include, for example, rotatable shafts configured to provide power take-off for powering one or more components of extendable sections 48, as described herein. In some implementations, first drive shaft 64 and second drive shaft 66 may be provided as single rotatable shafts extending through fixed screed 46. Additionally, or alternatively, first drive shaft 64 and second drive shaft 66 may include two or more shaft portions coupled, end-to-end, along a direction of extension through fixed screed 46. For example, in some implementations, first drive shaft 64 may include multiple shaft portions coupled, end-to-end, by way of one or more couplers (e.g., coupling joints, coupling members, and/or the like), to facilitate co-rotation of the shaft portions as a single shaft through fixed screed 46. In some implementations, first drive shaft 64 comprises a tamper shaft configured to actuate, power, or drive at least one tamper component (e.g., a tamper bar and/or the like). In some implementations, the tamper component may be configured to increase compaction of the material forming the roadway mat, which may form a more dense, higher-quality roadway mat.

As further shown in FIG. 2, and, in some implementations, fixed screed 46 can further comprise at least second drive shaft 66 extending therethrough. First and second drive shafts, 64 and 66, may extend substantially parallel to each other through fixed screed 46. In some implementations, second drive shaft 66 comprises a vibrating shaft configured to actuate, power, or drive at least one vibrating component (e.g., an eccentric weight and/or the like). In some implementations, the at least one vibrating component may be used to obtain a desired grain size distribution of the material forming the roadway mat, for providing a smooth surfaced roadway mat.

As further shown in FIG. 2, a first power transmitting component (PTC) 68 may be attached to and/or disposed proximate a first end of first drive shaft 64, and a second power transmitting component 70 may be disposed, opposite first power transmitting component 68, and attached to and/or disposed proximate a second end of first drive shaft 64. First and second power transmitting components, 68 and 70, may each include, for example, a pump (e.g., a gear pump, a diaphragm pump, a centrifugal pump, etc.), a motor (e.g., a gear motor, a hydraulically powered motor, an electric motor, etc.), a generator, and/or the like, configured to generate power upon rotation of first drive shaft 64, and transmit the power, generated by rotation of first drive shaft 64, to actuate one or more components of extendable sections 48. The power being generated by rotation of first drive shaft 64 may include, without limitation, a variable force, a pressure (e.g., a hydraulic pressure), a flow, electric power, and/or the like. In some implementations, first and second power transmitting components, 68 and 70, may include a same type of component (e.g., a pump, a motor, a generator, etc.). Additionally, or, alternatively, first and second power transmitting components, 68 and 70, may include different types of components, so that a combination of a pump, a motor, a generator, and/or the like, may be attached to and/or disposed on or over first drive shaft 64.

As further shown in FIG. 2, a third power transmitting component 72 may be attached to and/or disposed proximate a first end of second drive shaft 66, and a fourth power transmitting component 74 may be disposed, opposite third power transmitting component 72, and attached to and/or disposed proximate a second end of second drive shaft 66. Third and fourth power transmitting components, 72 and 74, may each include, for example, a pump, a motor, a generator, and/or the like, which is configured to generate power upon rotation of second drive shaft 66. The power may be transmitted to one or more components of extendable sections 48. In some implementations, the power may be generated upon rotation of a tamper and/or a vibrating shaft, and may be used to power a driven shaft (e.g., 82, described below) of extendable section 48, which may also include a tamper and/or a vibrating shaft. In some implementations, third and fourth power transmitting components, 72 and 74, may include a same type of component (e.g., a pump, a motor, a generator, etc.). Additionally, or, alternatively, third and fourth power transmitting components, 72 and 74, may include different types of components, so that a combination of a pump, a motor, a generator, and/or the like, may be attached to and/or disposed on or over second drive shaft 66.

In some implementations, respective first and second drive shafts 64 and 66, of fixed screed 46, by way of respective first to fourth power transmitting components 68 to 74, may provide power take-off to actuate one or more components of extendable sections 48. The power transmitted to extendable sections 48, for actuating the components thereof, may closely match the power generated by rotation of first and second drive shafts 64 and 66. The one or more components of extendable sections 48 that receive power take-off from respective first and second drive shafts, 64 and 66, may include, for example, one or more tamper components, one or more vibrating components, and/or one or more linear actuators (e.g., hydraulic powered extendable cylinders, electrical linear actuators, etc., by which extendable section 48 may extend or retract), as described herein.

As further shown in FIG. 2, and, in some implementations, extendable sections 48 may comprise one or more rotatable shaft assemblies and/or shafts (e.g., driven shafts), which may receive power take-off from the rotatable drive shafts of fixed screed (i.e., 64, 66, as described above), for powering one or more components attached thereto. Such rotatable shafts and/or shaft assemblies of extendable sections 48 may be disposed in and/or extend through a respective extendable section 48, along an axis that is orthogonally disposed, or substantially orthogonally disposed, relative to the direction D of travel of paving machine 10. In some implementations, extendable sections 48 includes at least a first driven shaft 80 and at least a second driven shaft 82.

In some implementations, first driven shaft 80 comprises a tamper shaft configured to actuate, power, or drive at least one tamper component upon rotation of first driven shaft 80. As first driven shafts 80, of extendable sections 48, may receive power take-off from first drive shaft 64, of fixed sections 52, a driven tamper component, attached to first driven shafts 80 of extendable sections 48, may rotate at about a same speed and/or about a same intensity as a driving tamper component, attached to first drive shaft 64 of fixed section 52. In this way, the tamper functionality (e.g., speed, intensity, etc.) implemented by fixed section(s) 52 of screed assembly 40 may be the same as and/or approximately the same as the tamper functionality implemented by extendable section(s) 48 of screed assembly 40. Further, in this way, increasing or decreasing the rotational speed of first drive shaft 64 of fixed section 52, may respectively increase or decrease the rotational speed of first driven shafts 80 of extendable sections 48.

In some implementations, second driven shaft 82 comprises a vibrating shaft configured to actuate, power, or drive at least one vibrating component. As second driven shafts 82, of extendable sections 48, may receive power take-off from second drive shaft 66, of fixed section 52, a driven vibrating component, attached to second driven shafts 82 of extendable sections 48, may rotate at a same or similar speed and/or a same or similar intensity as a driving vibrating component, attached to second drive shaft 66 of fixed section 52. In this way, the vibrating functionality implemented by fixed section(s) 52 of screed assembly 40 may be substantially the same as, or consistent with, the vibrating functionality implemented by extendable section(s) 48 of screed assembly 40.

In some implementations, extendable sections 48 may further comprise one or more linear actuating components. For example, extendable sections 48 may include a hydraulically actuated extendable cylinder. The extendable cylinders may linearly extend or retract, for moving or positioning extendable section 48. In some implementations, an effective width of screed assembly 40 may be adjusted by extending or retracting extendable section 48 (e.g., by extending or retracting extension cylinders in a direction indicated by the arrows in extendable sections 48) relative to fixed screed 46, as additional width may be provided, by the extension or retraction, to form roadway mats having wider tolerances.

As further shown in FIG. 2, extendable sections 48 may include a first power receiving component (PRC) 86 attached to and/or disposed proximate one end of first driven shaft 80. First power receiving components 86 may include, for example, a pump, a motor, and/or the like, which is configured to receive, as input, the power transmitted by first power transmitting component 68 and/or second power transmitting component 70, and output an amount of power or work (e.g., a torque), for rotating first driven shafts 80 of extendable sections 48. In some implementations, first power receiving components 86 are configured to actuate (i.e., rotate) first driven shafts 80 of extendable sections 48, which may further actuate tamper components attached to first driven shafts 80. In some implementations, first power receiving components 86 may further actuate vibrating components, extendable cylinders, and/or the like, thus, allowing provision of vibration and/or width adjustments by way of power take-off from fixed screed 46. In this way, a tamper component, a vibrating component, a linear actuator, and/or the like, may be actuated by way of power take-off from fixed screed 46, which obviates the need for long sections of hosing and/or wires typically required to route power to extendable sections 48.

As further shown in FIG. 2, extendable sections 48 may comprise a second power receiving component 88 attached to and/or disposed proximate one end of second driven shaft 82. Second power receiving component 88 may include, for example, a pump, a motor, and/or the like, which is configured to receive, as input, the power transmitted by third power transmitting component 72, and/or fourth power transmitting component 74, and output an amount of power or work (e.g., a torque), for rotating second driven shaft 82. For example, second power receiving components 88 may actuate second driven shafts 82, which may further actuate vibrating components attached to second driven shafts 82. In some implementations, second power receiving components 88 may, optionally, further actuate a linear actuator and/or one or more tamper components.

As indicated above, FIG. 2 is provided as an example. Other examples are possible and may differ from what was described in connection with FIG. 2. The components shown as being included in screed assembly 40, and the arrangement of these components, are provided for illustrative purposes only.

FIGS. 3-7 are schematic diagrams of example implementations of power take-off provided by a fixed screed 46 of a screed assembly 40, for powering components of extendable sections 48, of the screed assembly 40, that may be used in the paving machine 10 of FIG. 1. FIGS. 3-7 include systems or devices, which may be included in screed assembly 40 for providing power take-off from fixed screed 46, as described herein.

Figure 3:
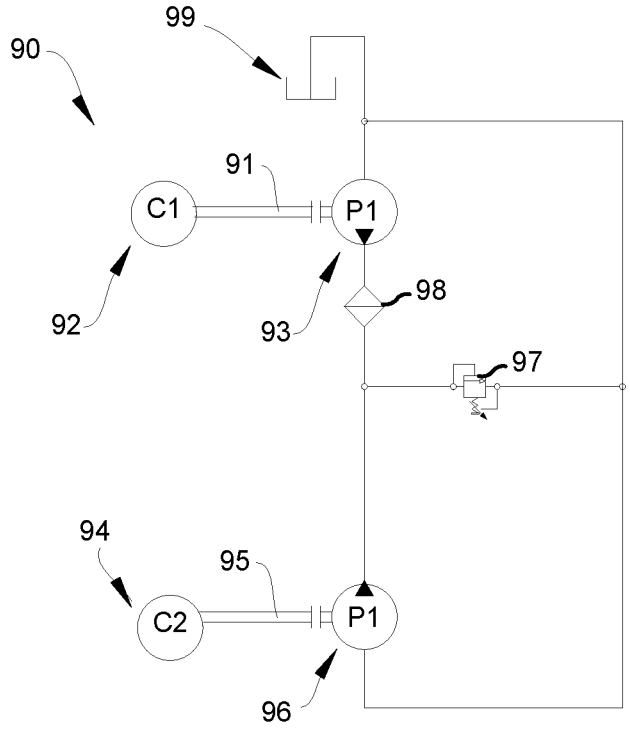
FIGS. 3-7 are schematic diagrams of example implementations of power take-off provided by a fixed screed of a screed assembly for powering components of extendable sections of the screed assembly, that may be used in the paving machine of FIG. 1.

Turning now to FIG. 3, a power take-off device or system, generally designated 90, is shown. System 90 may be included in a screed assembly (i.e., 40), and comprise a first rotatable shaft 91 (i.e., a drive shaft). First rotatable shaft 91 may be coupled to a first component 92 to rotatably actuate, power, or drive, first component 92. First component 92 may include, for example, and, without limitation, a tamper component, a vibrating component, and/or the like. First rotatable shaft 91 may be located or disposed in a fixed screed (i.e., 46) of the screed assembly.

In some implementations, a power transmitting component 93 may be mounted and/or disposed on or over first rotatable shaft 91 for receiving, as input, torque generated by first rotatable shaft 91 and transmit, as output, power (e.g., a pressure, flow, electricity, etc.,) for actuating a second component 94 disposed in an extendable section (i.e., 48, FIG. 2) of the screed assembly. Second component 94 may include a tamper component or a vibrating component. Additionally, or alternatively, second component 94 may include an extendable cylinder.

As a specific example, power transmitting component 93 may transmit, and, a power receiving component 96 may receive, hydraulic power, generated by way of rotating first rotatable shaft 91. Power receiving component 96 may be mounted or disposed on a second rotatable shaft 95 (i.e., a driven shaft) of the extendable section, and transmit the hydraulic power to rotate second rotatable shaft 95 and actuate second component 94. In this way, system 90 utilizes hydraulic power to provide power take-off for rotating second rotatable shaft 95 and actuating second component 94. As shown by FIG. 3, power transmitting component 93 and power receiving component 96 may both include a pump. Where multiple pumps are provided, at least one may be configured to act as a pump (e.g., and pump hydraulic fluid out), while the other may be configured to act as a motor (e.g., and transmit torque out). For example, in this case, power transmitting component 93 may include a pump functioning as a pump, while power receiving component 96 may include a pump configured to act as a motor. In this way, power transmitting component 93 and power receiving component 96 may include a same part, which may reduce the number of parts required for providing power take-off from the fixed screed.

As FIG. 3 further illustrates, system 90 may include a relief valve 97 for controlling pressure in system 90, a filter 98, for filtering hydraulic fluid flowing through system 90 (e.g., by way of power transmitting component 93 and power receiving component 96), and/or a reservoir/heat exchanger 99, for regulating aspects (e.g., volume, temperature, etc.) of the hydraulic fluid flowing through system 90.

Figure 4:
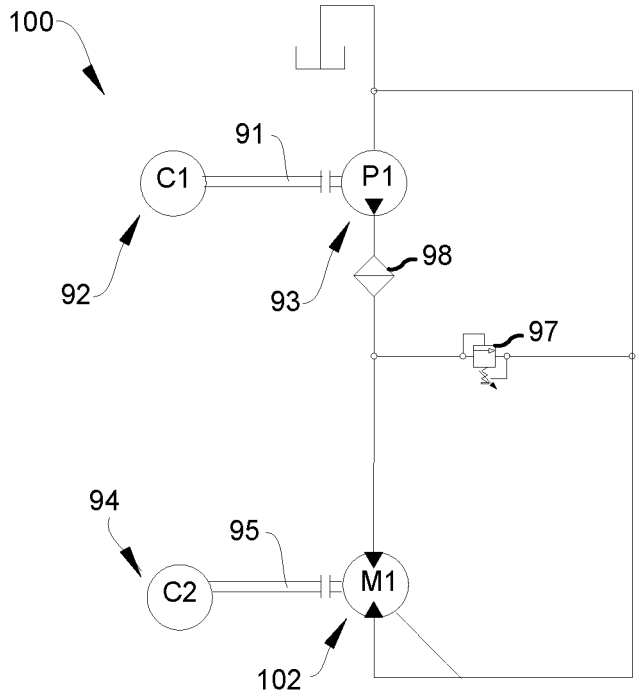

Turning now to FIG. 4, a further power take-off device or system, generally designated 100, is shown. System 100 may be included in a screed assembly, and may include many of the same components as system 90, described above. As FIG. 4 illustrates, however, a power receiving component 102 attached to second rotatable shaft 95 may include a motor. In some implementations, power transmitting component 93 may include a pump functioning as a pump, while power receiving component 102 may include a motor (e.g., a gear motor, etc.) functioning as a motor. Power receiving component 102 may be configured to receive, as input, power (e.g., a hydraulic power, flow, etc.), and generate, as output, torque and speed for rotating second rotatable shaft 95 and actuating second component 94.

Figure 5:
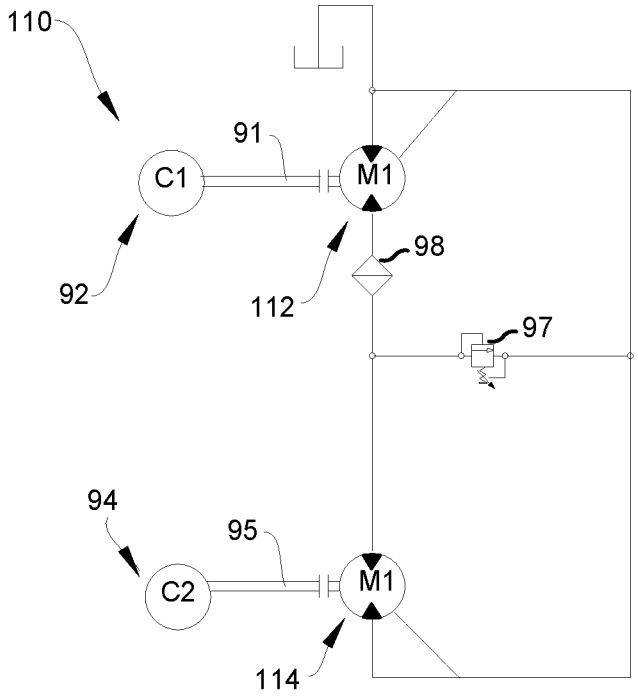

Turning now to FIG. 5, a further power take-off device or system, generally designated 110, is shown. System 110 may be included in a screed assembly, and may include many of the same components as system 90, described above. As FIG. 5 illustrates, however, a power transmitting component 112 and a power receiving component 114 may each include a motor. In some implementations, power transmitting component 112 may include a motor functioning as a pump, while power receiving component 102 may include a motor functioning as a motor.

Figure 6:
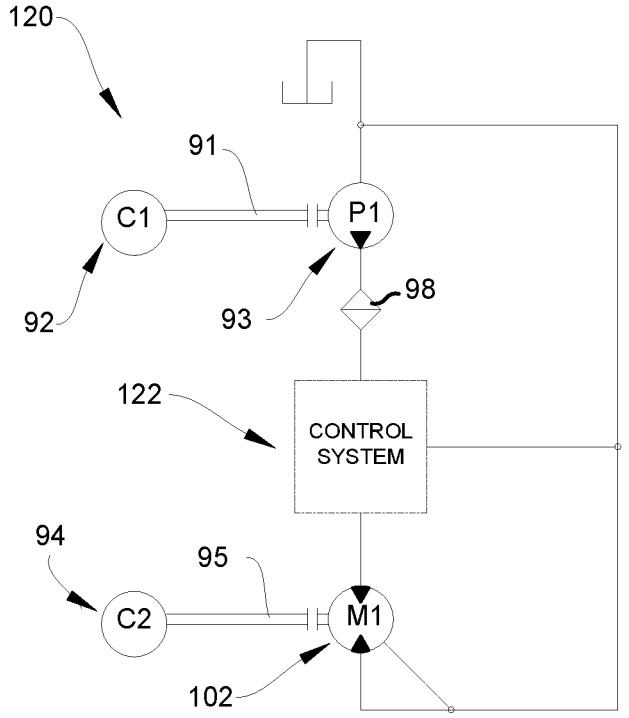

Turning now to FIG. 6, a further power take-off device or system, generally designated 120, is shown. System 120 may be included in a screed assembly, and may include many of the same components as system 100, described above. As FIG. 6 illustrates, however, a control system 122 may be disposed between a fixed section, including first rotatable shaft 91, and an extendable section, including power receiving component 102. Control system 122 may be configured to control (e.g., vary, alter, etc.) the output being provided to second rotatable shaft 95, so that, for example, second component 94 may be actuated at a different speed and/or intensity than first component 92. In this way, many different types of components may be powered by way of power take-off from first rotatable shaft 91.

For example, where previous systems (e.g., FIGS. 3-5) include power take-off provided by way of a direct, shaft-to-shaft translation, system 120 may adjust (e.g., increase, decrease, etc.) the power being provided to second rotatable shaft 95, so that second component 94 may be actuated according to a customized power need. As an example, control system 122 may adjust the power being provided to second rotatable shaft 95, for actuating a hydraulic extendable cylinder. As another example, control system 122 may adjust the power being provided to second rotatable shaft 95, for powering lights at an extendable section of a screed assembly, or for powering any other type of component positioned or disposed at the extendable section, for any purpose, not inconsistent with the present disclosure. In this way, system 120 may be used to provide power take-off for many different types of components, including components that may be actuated by non-shaft-to-shaft power schemes, as described below in regard to FIG. 7.

Figure 7:
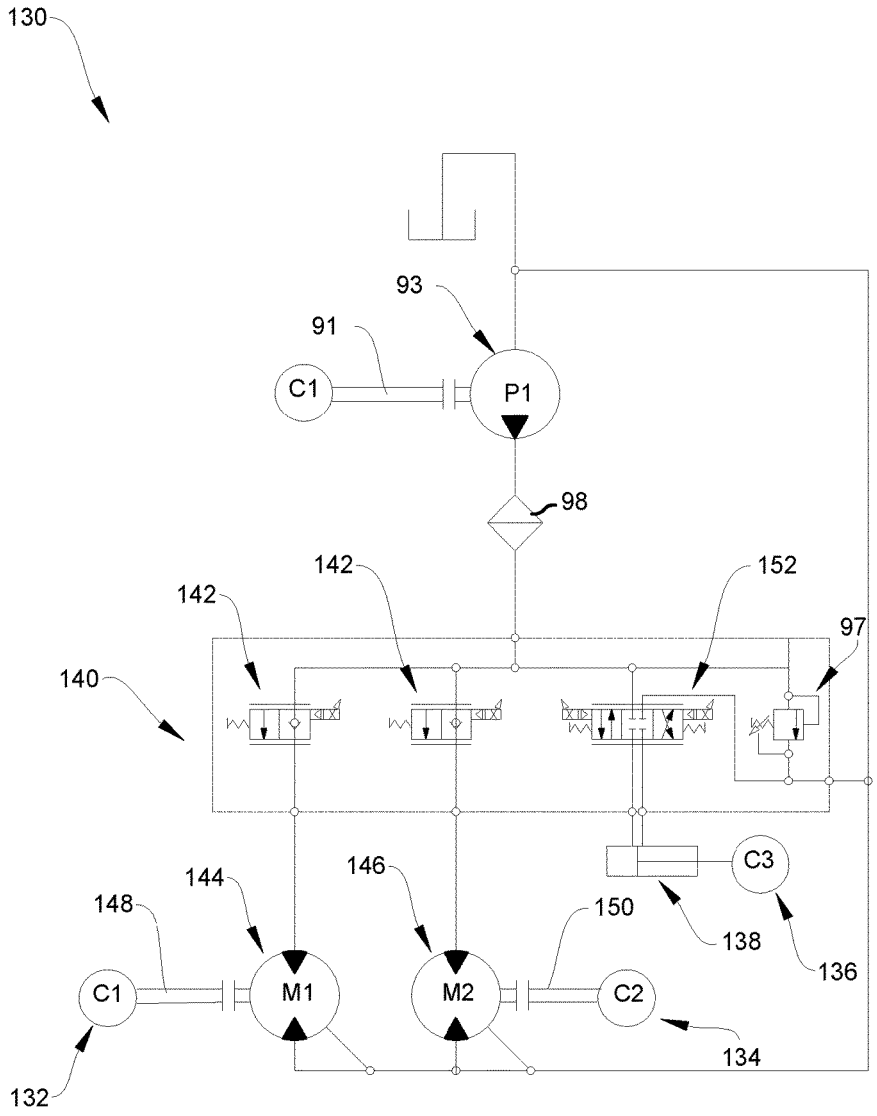

Turning now to FIG. 7, a further power take-off device or system, generally designated 130, is shown. System 130 may be included in a screed assembly, and may include many of the same components as FIGS. 3-6, described above. As shown by FIG. 7, first rotatable shaft 91 of a fixed screed, may provide power take-off to many different components of an extendable section of a screed assembly. In some implementations, power take-off may be provided to at least a first component 132, a second component 134, and a third component 136, each of which may be located or disposed in an extendable section of a screed assembly. As a specific example, first component 132 may include a tamper or vibrating component, second component 134 may include a tamper or vibrating component, and third component 136 may include an extendable cylinder 138. Other components are contemplated.

As further shown in FIG. 7, a control system 140 may be used to regulate or control hydraulic pressure and/or flow and, thus, an amount of power being transmitted to the various components (i.e., 132, 134, 136), of system 130. Control system 140 may include one or more flow regulating controls 142 for regulating an amount of power transmitted to a first power receiving component 144 and/or a second power receiving component 146 of an extendable section of a screed assembly. Flow regulating controls 142 may include, for example, one or more valves (e.g., a check valve, control valve, relieve valve, etc.). First power receiving component 144 may rotate a first rotatable shaft 148 (i.e., a driven shaft), for actuating first component 132. Similarly, second power receiving component configured to rotate a second rotatable shaft 150 (i.e., a driven shaft), for actuating second component 134.

As further shown in FIG. 7, control system 140 may further comprise one or more flow regulating controls 152 for regulating an amount of flow transmitted to extendable cylinder 138. In some implementations, flow regulating controls 152 supply hydraulic flow to linearly actuate extendable cylinder 138. In this way, power take-off may be provided by manipulating a magnitude or amount of hydraulic power supplied to a component, in addition to and/or as an alternative to power take-off provided by shaft-to-shaft actuation.

As indicated above, FIGS. 3-7 are provided as examples. Other examples are possible and may differ from what was described in connection with FIGS. 3-7. In other words, the number and arrangement of components shown for providing power take-off from a fixed section of a screed assembly are provided for illustrative purposes only. Rather, the power take-off schematic diagrams, as described herein are not intended to be limiting, but are intended to be illustrative of apparatuses and applications in which implementations described herein may be employed. For example, while FIGS. 3-7 primarily show and describe hydraulic components, the use of electrical components, pneumatic components, magnetic components, mechanical components, and/or the like, are also contemplated herein.

INDUSTRIAL APPLICABILITY

The disclosed screed assembly 40, including fixed screed 46 with power take-off for powering extendable sections 48, or portions thereof, may be used with any machine in which improved power distribution is desired, such as paving machine 10.

In operation, fixed screed 46 may provide power take-off to components (e.g., 132-136, FIG. 7) associated with extendable section 48, of screed assembly 40, upon rotation of one or more drive shafts (e.g., 64, 66) associated with fixed screed 46. As described above, a power transmitting component (e.g., 68, 70, 72, 74) is configured to provide power take-off by way of generating power upon rotation of a drive shaft (e.g., 64, 66), which may include a tamper and/or a vibrating shaft, and translate the power to a driven shaft (e.g., 80, 82) of extendable section 48, which may also include a tamper and/or vibrating shaft. The power translated to the driven shaft may be performed without the need for a direct mechanical connection of the driven shaft to the paving machine 10, and/or the base screed 50. In this way, routing power to extendable sections 48 may be improved. Further, in this way, the tamper and/or vibration speed (e.g., revolutions per minute (rpms)) provided by components of the driven shaft may be the same as and/or closely match the tamper and vibration speed provided by components of the drive shaft. In this way, the tamper and vibrating functionality implemented by screed assembly 40 may improve, and provide more uniform, smooth, and/or evenly distributed roadway mats.

In other words, the disclosed screed assembly improves the consistency and/or uniformity being provided by the tamper components and the vibrating components of fixed screed 46 and extendable section 48. That is, the tamper and vibrating properties (e.g., speed, intensity, and/or the like)

provided by the extendable section 48 may more closely match the tamper and vibrating properties provided by the fixed screed 46.

What is claimed is:

1. A paving machine, comprising:

a screed assembly including a fixed screed and an extendable section disposed proximate an end of the fixed screed, wherein:

the fixed screed comprises:

a first drive shaft that extends through one or more portions of the fixed screed, and a second drive shaft that extends through the one or more portions of the fixed screed, the one or more portions of the fixed screed comprise one or more of a base screed or a fixed section, the extendable section comprises a driven shaft, a power transmitting component is coupled to the first drive shaft, and the power transmitting component is configured to generate power in response to rotation of the first drive shaft, for actuating the driven shaft.

2. The paving machine of claim 1, wherein a power receiving component is coupled to the driven shaft, and wherein the power receiving component is configured to receive the power generated by the power transmitting component, and output torque and speed, for rotating the driven shaft.

3. The paving machine of claim 2, wherein the power transmitting component is a pump, a motor, or a generator, and wherein the power receiving component is a pump, a motor, or a generator.

4. The paving machine of claim 1, wherein at least one vibrating component is attached to the second drive shaft, wherein at least one tamper component is attached to the first drive shaft, and wherein at least one vibrating component or at least one tamper component is attached to the driven shaft.

5. The paving machine of claim 1, wherein the power transmitting component is configured to generate power in response to rotation of the first drive shaft, for actuating an extendable cylinder.

6. The paving machine of claim 1, wherein the driven shaft is configured to rotate at approximately a same revolution per minute as the first drive shaft.

7. The paving machine of claim 1, wherein increasing a first rotational speed of the first drive shaft increases a second rotational speed of the driven shaft, and wherein decreasing the first rotational speed of the first drive shaft decreases the second rotational speed of the driven shaft.

8. A screed assembly, comprising:

a fixed screed comprising:

a first drive shaft that extends through one or more portions of the fixed screed, and a second drive shaft that extends through the one or more portions of the fixed screed, wherein the one or more portions of the fixed screed comprise one or more of a base screed or a fixed section;

an extendable section extending from a portion of the fixed screed, wherein the extendable section comprises a driven shaft; and a power transmitting component coupled to the first drive shaft, wherein the power transmitting component is configured to generate power during rotation of the first drive shaft, and wherein the power is configured to actuate the driven shaft.

9. The screed assembly of claim 8, wherein the power transmitting component is a pump, a motor, or a generator.

10. The screed assembly of claim 8, wherein a first vibrating component is attached to the first drive shaft and a second vibrating component is attached to the driven shaft.

11. The screed assembly of claim 8, wherein a first tamper component is attached to the first drive shaft and a second tamper component is attached to the driven shaft.

12. The screed assembly of claim 8, wherein the power is configured to actuate an extendable cylinder disposed in the extendable section of the screed assembly.

13. The screed assembly of claim 8, wherein the driven shaft is configured to rotate at approximately a same revolution per minute as the first drive shaft.

14. The screed assembly of claim 8, wherein increasing a first rotational speed of the first drive shaft increases a second rotational speed of the driven shaft, and wherein decreasing the first rotational speed of the first drive shaft decreases the second rotational speed of the driven shaft.

15. An extendable section for a screed assembly, comprising:

a rotatable shaft; and a power receiving component attached to the rotatable shaft, wherein the power receiving component is configured to receive power generated during rotation of a first drive shaft of a fixed screed, and generate torque and speed for rotating the rotatable shaft, wherein the fixed screed includes the first drive shaft and a second drive shaft, wherein the first drive shaft extends through one or more portions of the fixed screed, wherein the second drive shaft extends through the one or more portions of the fixed screed, wherein the one or more portions of the fixed screed include one or more of a base screed or a fixed section, wherein increasing a driving rotational speed of the first drive shaft increases a driven rotational speed of the rotatable shaft, and wherein decreasing the driving rotational speed of the first drive shaft decreases the driven rotational speed of the rotatable shaft.

16. The extendable section of claim 15, wherein the power receiving component is a pump, a motor, or a generator.

17. The extendable section of claim 15, wherein the rotatable shaft and the driving shaft rotate at approximately a same revolution per minute.

18. The extendable section of claim 15, wherein a tamper component is attached to the rotatable shaft.

19. The extendable section of claim 15, wherein a vibrating component is attached to the rotatable shaft.

20. The extendable section of claim 15, wherein the power receiving component is configured to actuate an extendable cylinder disposed in the extendable section.

* * * * *